US006520866B1

(12) United States Patent
Suzuki

(10) Patent No.: US 6,520,866 B1
(45) Date of Patent: Feb. 18, 2003

(54) PUTTING-PRACTICING APPARATUS

(76) Inventor: Yosiharu Suzuki, 1-73 Meitoku-cho Nakagawa-ku, Nagoya Aichi (JP)

( * ) Notice: Subject to any disclaimer, the term of this patent is extended or adjusted under 35 U.S.C. 154(b) by 0 days.

(21) Appl. No.: 09/565,153

(22) Filed: May 3, 2000

(30) Foreign Application Priority Data

May 19, 1999 (JP) ..... 11-175899

(51) Int. Cl.[7] ..... A63B 69/36
(52) U.S. Cl. ..... 473/267; 473/268
(58) Field of Search ..... 473/266, 267, 473/247, 268, 219

(56) References Cited

U.S. PATENT DOCUMENTS 5,116,058 A * 5/1992 Theriault ..... 473/268
5,294,124 A * 3/1994 Florian ..... 473/267
5,518,244 A * 5/1996 Borlik ..... 473/267 X
5,634,858 A * 6/1997 Bellagamba ..... 473/257
5,842,932 A * 12/1998 Goddard ..... 473/267 X
6,146,285 A * 11/2000 Winslow ..... 473/219

FOREIGN PATENT DOCUMENTS

GB 2238249 * 5/1991 ..... 273/35 A

* cited by examiner

*Primary Examiner*—Raleigh W. Chiu
(74) *Attorney, Agent, or Firm*—Koda & Androlia

(57) ABSTRACT

A putting-practicing apparatus in which a mirror (2) and a level (3) are installed on abase plate (1) at required positions thereof; the base plate (1) is installed on a holding tool (5) through an angle-adjusting device (4); and a space allowing a putter to be stroked is provided below the mirror (2).

2 Claims, 3 Drawing Sheets

PUTTING-PRACTICING APPARATUS

BACKGROUND OF THE INVENTION

1. Field of the Invention

The present invention relates to a putting-practicing apparatus provided with a mirror.

2. Description of the Related Art

In addressing a golf ball with a putter, it is necessary to make a stroke line parallel with a straight line connecting player's eyes with each other, and place the golf ball on the ground (floor) at a position thereof approximately right below the eye or at a position thereof a little outer (distant) from the position right below the eye in the direction orthogonal to the stroke line.

The conventional method of practicing addressing the golf ball is carried out as follows by a method (1) or a method (2).

(1) Picking up the golf ball with fingers, the player brings the golf ball into contact with one eye and looks downward. Then, the player releases the golf ball from the hand. The position of the ground (floor) at which the golf ball has dropped is the position right below the one eye.

(2) The player sets the golf ball on the ground (floor) and addresses the golf ball. Then, the player holds a string-connected punched coin at a level a little below one eye. Then, the player drops it vertically to check whether the set golf ball is located right below the coin.

The above practicing methods are unscientific.

Any of the conventional practicing methods allows the player to check whether the positional relationship between the player's eyes and the set golf ball is correct, but it is difficult to check whether the stroke line is parallel with the straight line connecting player's eyes with each other. Thus, it is difficult to practice putting the golf ball.

SUMMARY OF THE INVENTION

The present invention has been made in view of the above-described problem. Thus, it is an object of the present invention to provide a putting-practicing apparatus having a simple construction and allowing a player to practice addressing and putting golf balls easily on both an inclined surface and a horizontal surface.

To achieve the object, in a putting-practicing apparatus of the present invention, it is preferable that a base plate is installed on a holding tool through a supporting tool; a mirror is installed on the base plate at a required position thereof; and a space allowing a putter to be stroked is provided below the mirror.

In a putting-practicing apparatus of the present invention, it is preferable that a base plate is installed on a holding tool through a supporting tool and an angle-adjusting device; a mirror is installed on the base plate at a required position thereof; and a level is installed on the base plate at a required position thereof that is interlocked with the mirror.

It is most advantageous to use a spherical joint capable of adjusting the angle of the base plate omnidirectionally as the angle-adjusting device. However, as the angle-adjusting device, it is possible to use a device movable on a fulcrum, a flexible tube, and the like as effective as the spherical joint. It is most effective to install the angle-adjusting device on the base plate such that the angle-adjusting device is disposed at a side of the base plate opposite to a side thereof at which the mirror is installed.

The holding tool may be trapezoidal, leg-shaped, pin-shaped, and in other shapes. But it is most favorable that the holding tool is rectangular plate-shaped.

According to the putting-practicing apparatus of the present invention, while a player is watching his/her eyes reflected in the mirror, he/she can easily check whether the straight line connecting his/her eyes with each other and a stroke line are parallel with each other, whether the positional relationship between his/her eyes and a golf ball set on the ground (floor) is correct, the backstroke of a putter, putting, and follow-through. Because the angle-adjusting device adjusts the angle of the base plate, he/she can practice putting the golf ball on an inclined surface, a horizontal surface, indoors, on putting green, and the like.

BRIEF DESCRIPTION OF THE DRAWINGS

The present invention will become more fully understood from the detailed description given below and the accompanying drawings which are given by way of illustration only, and thus are not limitative of the present invention, and wherein.

DETAILED DESCRIPTION OF THE PREFERRED EMBODIMENTS

Figure 1:
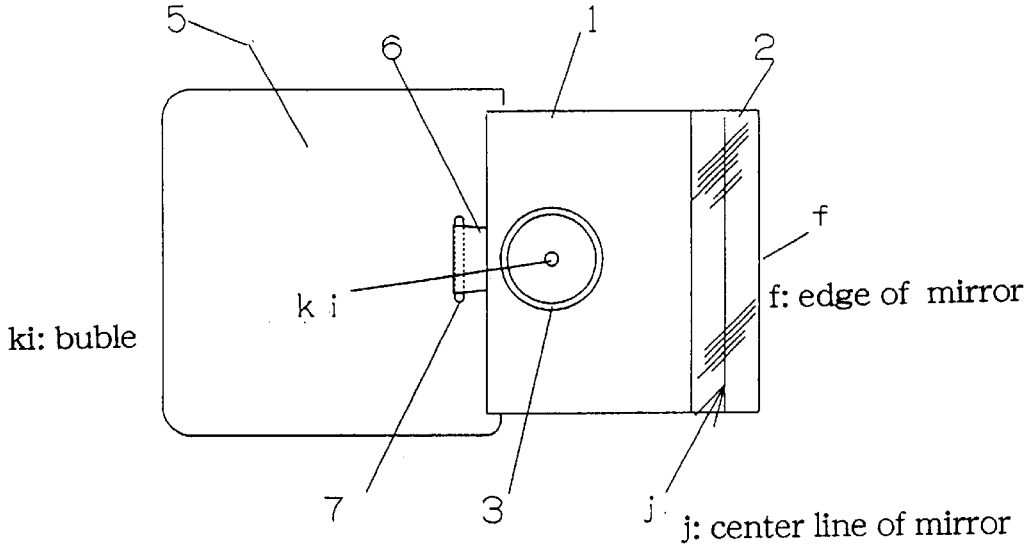
FIG. 1. is a plan view showing a putting-practicing apparatus of an embodiment of the present invention.
Figure 2:
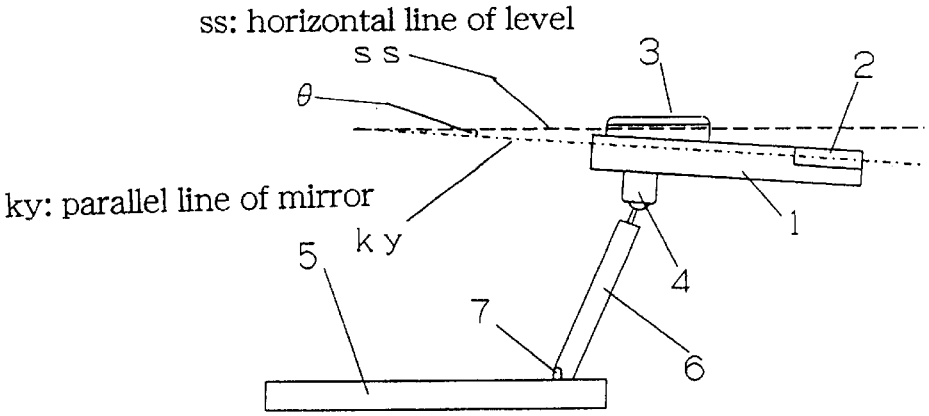
FIG. 2 is a side view showing the putting-practicing apparatus shown in FIG. 1.
Figure 5:
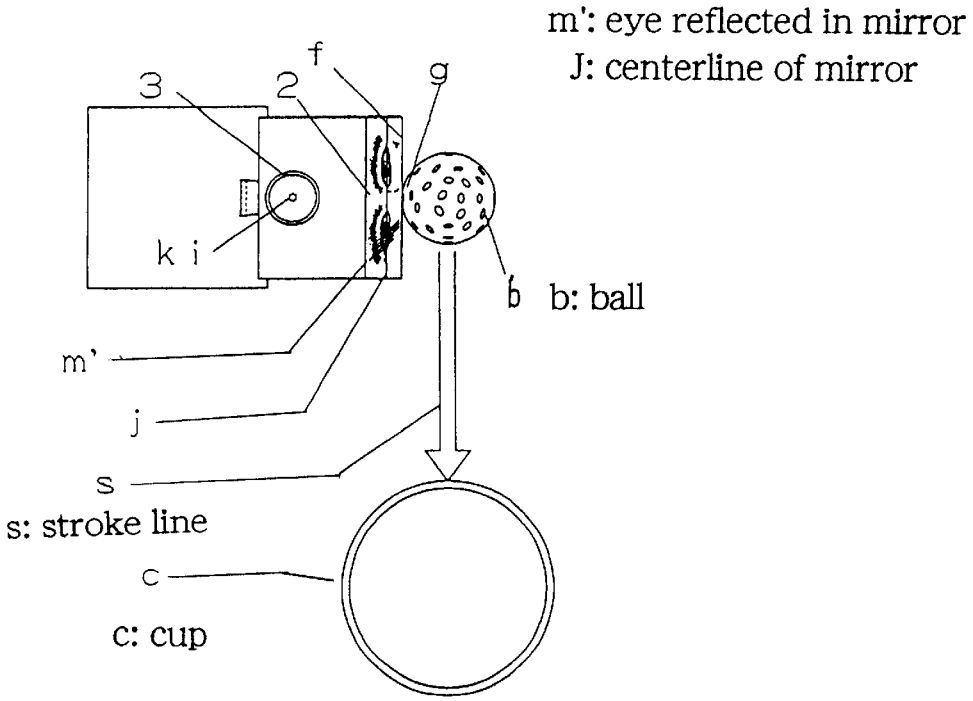
FIG. 5 is a plan view for describing a state in which the putting-practicing apparatus shown in FIGS. 1 and 2 is used.
Figure 6:
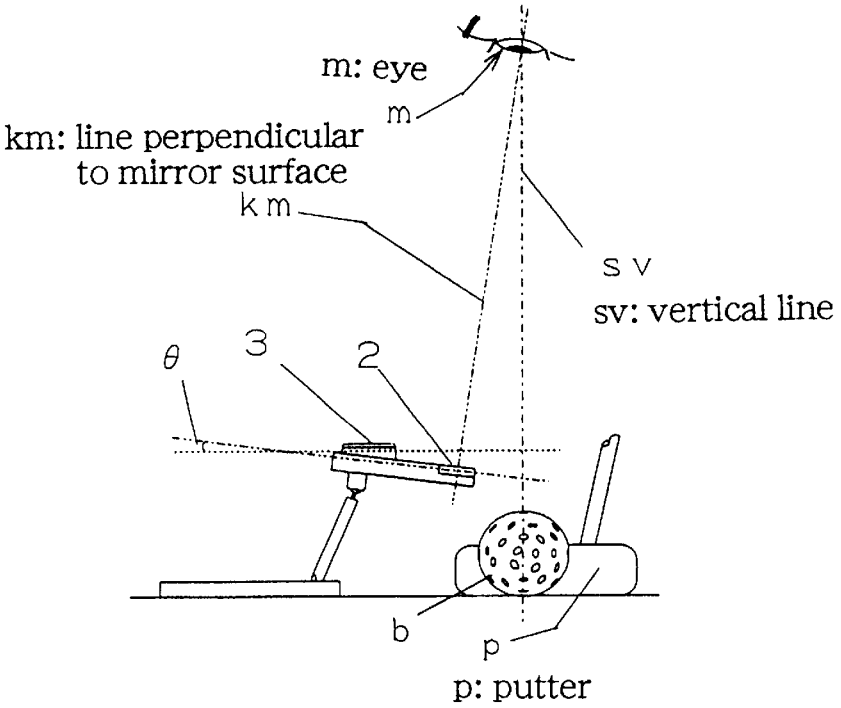
FIG. 6 is a side view for describing the state in which the putting-practicing apparatus shown in FIGS. 1 and 2 is used.

A putting-practicing apparatus according to an embodiment of the present invention will be described below with reference to the drawings. Referring to FIGS. 1 and 2, a mirror 2 is installed at one side of an upper surface of a rectangular plate-shaped base plate 1 made of synthetic. resin. A level 3 is installed on the base plate 1 by disposing it near the end of the other side (side opposite to the mirror-installing side) of the upper surface of the base plate 1. An angle-adjusting device 4 consisting of a spherical joint is installed on a lower surface of the base plate 1 by disposing the angle-adjusting device 4 approximately right below the level 3 installed on the upper surface of the base plate 1. The angle-adjusting device 4 is installed on a supporting tool 6 mounted on a holding tool 5 through a fulcrum shaft 7. The mirror 2 and the level 3 are installed on the upper surface of the base plate 1 such that a line ky parallel with the upper surface of the mirror 2 forms an angle θ with a horizontal line ss parallel with the upper surface of the level 3. Referring to FIGS. 5 and 6, the angle θ is so adjusted that a player's eye m is located approximately right above a golf ball set on the ground (floor), i.e., the eye m lies on a vertical line sv, when an image m' of the eye m is reflected in the mirror 2 by lying the eye m on a line km perpendicular to the upper surface of the mirror 2, with a bubble ki of the level 3 positioned at its center.

Figure 3:
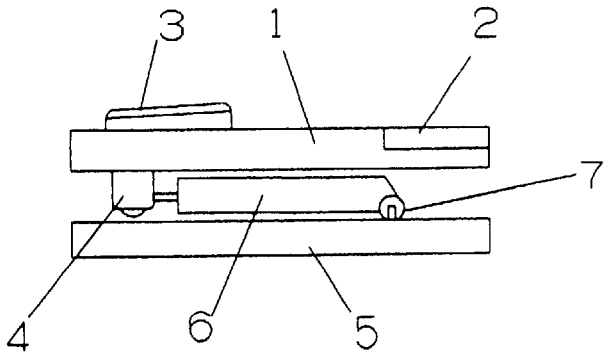
FIG. 3. is a side view showing a state in which the putting-practicing apparatus is folded.
Figure 4:
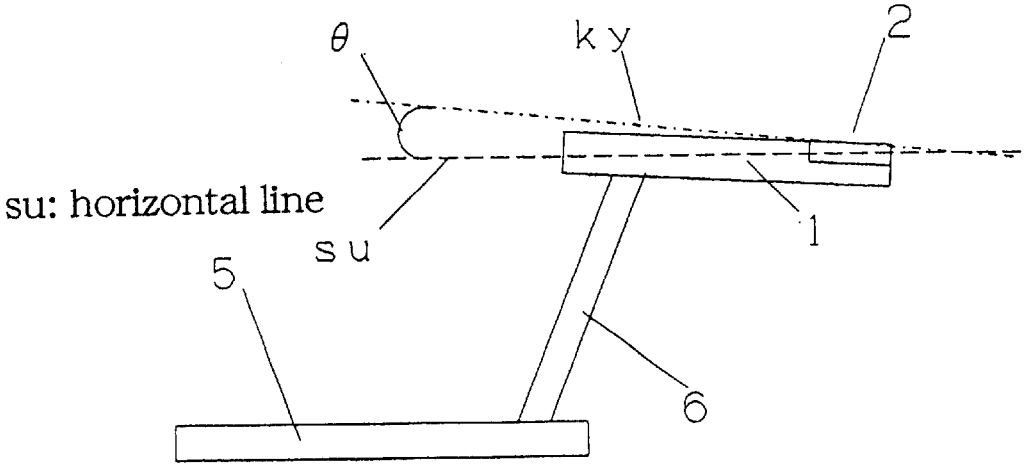
FIG. 4 is a side view showing a putting-practicing apparatus of another embodiment of the present invention.

A space allowing a putter p to be stroked is provided below the mirror 2. As shown in FIG. 3, the putting-practicing apparatus is foldable owing to the operation of the angle-adjusting device (spherical joint) 4 and the fulcrum shaft 7.

In the embodiment, as shown in FIG. 5, first, the putting-practicing apparatus is set in a selected place (inclined surface or horizontal surface). Then, a centerline j of the mirror 2 is set in parallel with a stroke line S. Then, the angle of the base plate 1 is so adjusted by the angle-adjusting device 4 that the bubble ki of the level 3 is located at the center of the level 3. Then, a golf ball b is so set on the selected place that a spherical point g of the golf ball b is tangent to an imaginary plane extending downward vertically from an edge f of the mirror 2 toward the ground (floor). Then, as shown in FIG. 6, the player sets his/her eyes m on the line km perpendicular to the upper surface of the mirror 2. As a result, the image m' of the eyes m is coincident with the center line j of the mirror 2. As described above, the mirror 2 and the level 3 are installed on the base plate 1 such that the line ky parallel with the upper surface of the mirror 2 forms the angle θ with the horizontal line ss parallel with the upper surface of the level 3. Accordingly, the golf ball b and the eye m lie on the vertical line sv. That is, the golf ball b is located approximately right below the eye m. Further, the straight line connecting the eyes m with each other is parallel with the stroke line s.

The present invention is not limited to the above-described embodiment. That is, the putting-practicing apparatus can be used on both a horizontal surface and an inclined surface owing to the operation of the level 3 and the angle-adjusting device 4. If the putting-practicing apparatus is used on only the horizontal surface, the putting-practicing apparatus is not necessarily provided with the level 3 and the angle-adjusting device 4. However, it is advantageous to provide the putting-practicing apparatus with the level 3. The mode and type of the level 3, the angle-adjusting device 4, and the supporting tool 6 may be appropriately altered. The holding tool 5 of the embodiment is rectangular plate-shaped, but may be pin-shaped, leg-shaped or in other shapes.

According to the putting-practicing apparatus of the present invention, a player can easily check whether the straight line connecting his/her eyes with each other and the stroke line are parallel with each other, whether the positional relationship between his/her eyes and a golf ball set on the ground (floor) is correct, the backstroke of a putter, putting, and follow-through. Further, he/she can practice putting the golf ball by setting it on both a horizontal surface and an inclined surface. Thus, he/she can practice putting the golf ball without worrying about whether the straight line connecting his/her eyes with each other and the stroke line are parallel with each other and whether the positional relationship between his/her eyes and the golf ball set on the ground (floor) is correct.

Further, because the putting-practicing apparatus is foldable, the player can carry it with him/her easily.

The invention being thus described, it will be obvious that the same may be varied in many ways. Such variations are not regarded as a departure from the spirit and scope of the invention, and all such modifications as would be obvious to one skilled in the art are intended to be included within the scope of the following claims.

What is claimed is:

1. A putting-practicing apparatus in which a base plate is installed on a holding tool through a supporting tool; a mirror is installed on said base plate at a required position thereof; and a space allowing a putter to be stroked is provided below said mirror; and wherein a level is installed on said base plate at a required position thereof which is interlocked with said mirror.

2. A putting-practicing apparatus according to claim 1, wherein said base plate is installed on said supporting tool through an angle-adjusting device.

* * * * *